United States Patent [19]

Barlow

[11] 4,271,628

[45] Jun. 9, 1981

[54] GEOMETRIC CONSTRUCTION TOY APPARATUS

[76] Inventor: John V. Barlow, 2289 McBain Ave., Vancouver, British Columbia, Canada, V6L 3B2

[21] Appl. No.: 64,025

[22] Filed: Aug. 6, 1979

[51] Int. Cl.[3] ..... A63H 33/10

[52] U.S. Cl. ..... 46/29; 434/211; 434/403

[58] Field of Search ..... 46/26, 29; 35/18 A, 35/34, 72

[56] References Cited

U.S. PATENT DOCUMENTS

| | | | |
|---|---|---|---|
| 1,092,217 | 4/1914 | Hopkins | 46/29 |
| 2,846,809 | 8/1958 | Majewski | 46/29 |
| 2,970,388 | 2/1961 | Yonkers | 35/18 A |
| 3,830,011 | 4/1973 | Ochrymowich | 46/29 |
| 3,998,003 | 12/1976 | Rosenbaum | 46/26 X |

FOREIGN PATENT DOCUMENTS

| | | | |
|---|---|---|---|
| 247160 | 1/1961 | Australia | 46/29 |
| 561770 | 11/1957 | Belgium | 46/29 |
| 4568 | of 1912 | United Kingdom | 46/29 |

*Primary Examiner*—F. Barry Shay

*Attorney, Agent, or Firm*—Fulwider, Patton, Rieber, Lee & Utecht

[57] ABSTRACT

Toy apparatus for the formation of 2- and 3-dimensional geometrical structures and including a plurality of substantially spherical connector members each having a plurality of radial sockets or prongs arranged around a central point in the connector member, a plurality of slender connecting members in groups of different lengths and having opposite ends to fit in the sockets or to receive the prongs, said sockets or prongs of each connector member body being arranged in patterns that enable the connector members to be interconnected by the connecting member to form tetrahedron, octahedron and cube structures.

22 Claims, 22 Drawing Figures

1ST ORDER

2 ND ORDER

3 RD ORDER

GEOMETRIC CONSTRUCTION TOY APPARATUS

Figure 1:
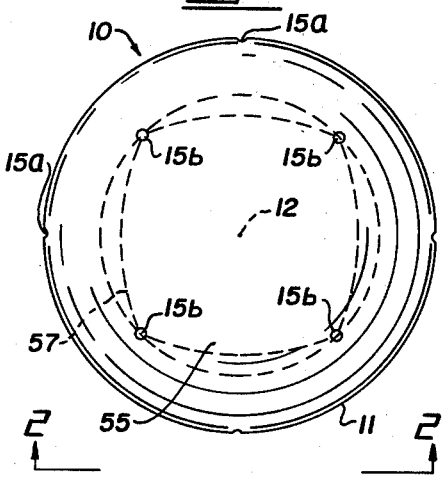

This invention relates to toy structure apparatus of the type which may be used to form geometrical structures for enjoyment and educational purposes.

Construction toy devices appear in the prior art, and the closest to the present invention, as far as the applicant knows, is shown in U.S. Pat. No. 3,998,003 dated Dec. 21, 1976 to S. Rosenbaum. The toy device of the patent includes a plurality of round elastic linking members having sockets therein to receive and frictionally retain end portions of rigid elongate strut members, all of which are of the same length. The pattern of the sockets in the linking members is such that a plurality of equilateral triangles or pyramids formed of equilateral triangles may be built, said linking members having therein special sockets for use in interconnecting the triangles or pyramids. These special sockets cannot be used in the construction of the equilateral triangles and pyramids themselves.

On the other hand, toy apparatus in accordance with the present invention is such that a wide variety of 2-dimensional and/or 3-dimensional structures can be formed, and easily and directly incorporated into more complex geometric structures. These structures are based on the central and vertex intersections of the tetrahedron, octahedron and cube. The toy includes a plurality of connector members each having a plurality of radial joint means arranged around a central point therein. These joint means are arranged in one or more patterns or orders that are completely novel. The apparatus also includes a plurality of elongate and slender connecting members each having joint means at the ends thereof and adapted to co-operate with the joint means of the connector members to interconnect said connector members to each other in desired structures. These connecting members are divided into a plurality of groups of different lengths, and these lengths are related to the functional capacities of the joint means of the connector members and said connecting members.

Toy apparatus in accordance with this invention comprises a plurality of substantially spherical connector members each having an interior central point, each of said connector members having a plurality of radial first joint means arranged around the central point of the connector member, all of said first joint means of each connector member being on opposite ends of axes of rotational symmetry through the central point, said first joint means being arranged symmetrically around the ends of said axes, first locating means at each first joint means, all of the first locating means of each connector member being equidistant from the central point of said member and being on an effective diameter of said each connector member, a plurality of elongate and slender connecting members each having second joint means at opposite ends thereof adapted to co-operate with the first joint means of connector members to interconnect the connector members and connecting members, and second locating means adjacent each of the opposite ends of each connecting member, the distance between the second locating means of said each connecting member constituting the effective length of the latter connecting member, and when connector members and connecting members are being interconnected by the first and second joint means thereof, the first and second locating means thereof co-operate to position said connecting members angularly in lines forming vertices and central intersections of regular tetrahedron, octahedron and cube structures.

The connecting members are preferably divided into a plurality of groups of different lengths, the lengths of the members of a first of said groups being basic, and the lengths of the members of the remainder of said groups being different from each other and each being proportional to the length of the first group.

It is preferable that the connector member be spherical, but the surface can be formed in any suitable substantially spherical shape as long as the locating means thereof are equidistant from a central point of this member. In the preferred form of the invention, the joint means of the connector member comprises a plurality of outwardly opening radial sockets arranged in predetermined patterns or orders around the central point of the connector member. In this case, the joint means of the connecting members are the opposite ends of said connecting members shaped and sized to fit firmly in the connecting member sockets.

As an alternative, the joint means of each connector member comprises a plurality of radial prongs arranged around the central point of said member in the predetermined patterns or orders. The joint means of the connecting members are sockets in the ends of these members opening out therefrom and sized to receive and removably grip said connector member prongs.

As stated above, the present invention involves substantially spherical connector members or bodies having patterns of radial joint means in the form of sockets opening out from the surface thereof or prongs radiating from said surface. The use of a connector member or body of generally spherical shape allows for the greatest possible number of planes of interconnection, these being planes of structures created by assembling this toy apparatus. The connector members are preferably rigid and can be interconnected by the slender connecting members to produce basic geometric forms. These connector members or bodies may be made of any suitable rigid material such as plastic, wood or metal.

The preferred arrangement of sockets or prongs of the connector body was determined by the study of the simplest configurations possible by the use of a set of 3 to 9 spheres considered as the points of interconnection in the assembled structures. Both 2- and 3-dimensional configurations were considered which reduce as much as possible the number of different connecting member lengths and different relative socket or prong angles necessary for their construction.

First of all, attention was given to determining a series of 3-dimensional configurations. It was found that by arranging the connector bodies to form a tetrahedron octahedron or cube and by arranging these forms around a central connector body that a complete series could be made which meets the optimal conditions expressed above. Attention was then given to determining 2-dimensional series of configurations composed of 3 to 9 spheres optimized in the same manner. In this case, the result was a series of 7 polygonal configurations and 6 radial configurations hereinafter illustrated and described.

These 2- and 3-dimensional series of configurations represent the range of most useful possible interconnections for a geometrically based construction toy. As the first priority in designing the present toy apparatus was to provide improved means with which to build 3-dimensional structures, it was considered most desirable to arrange the sockets or prongs of the connector bodies to provide for constructing tetrahedron, octahedron or cube structures with or without central connector bodies and within this limitation as many as possible of the 2-dimensional configurations.

In addition to the above, the present invention involves the provision of connecting members of geometrically determined lengths for the construction of the optimal configurations. It was determined that a connecting member for making vertex to vertex connections, that is, exterior edge connections, in the tetrahedron, octahedron or cube structures be provided and preferably distinctively marked in suitable manner, such as by colour. In addition to this basic connecting member, three shorter connecting members of different lengths where provided for the internal structure of the optimal configurations. It also is preferable to distinctively mark these shorter members in a suitable manner, such as by different colours.

To provide means whereby the correct length of connecting members for a given configuration may be identified, the surface of each connector body is divided by any visual means into multiples of three different regions. One way of doing this is by means of three different colours, and in this case, the connecting members can be colour coded relative to the specific region colours.

In the preferred form of the invention each connector body or member has a first order, a second order, a third order and a fourth order of joint means, and there are groups of flexible connecting members of four different lengths. The surface of each connector body is divided into multiples of three regions, and the connecting members are coded in accordance with said regions.

Figure 2:
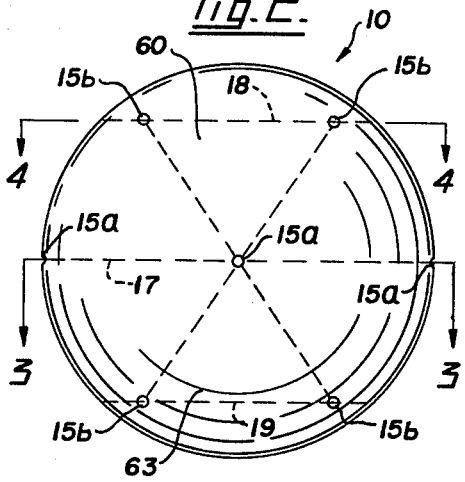
Figure 7:
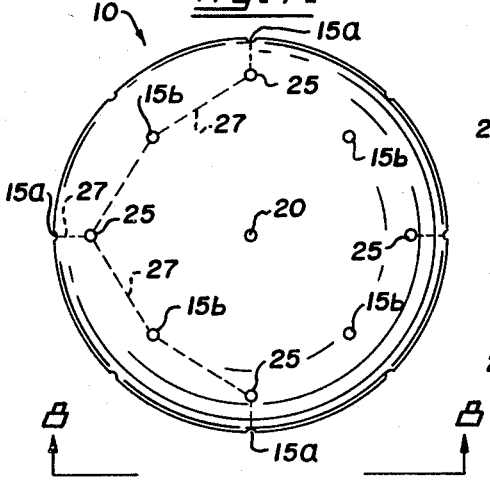
Figure 8:
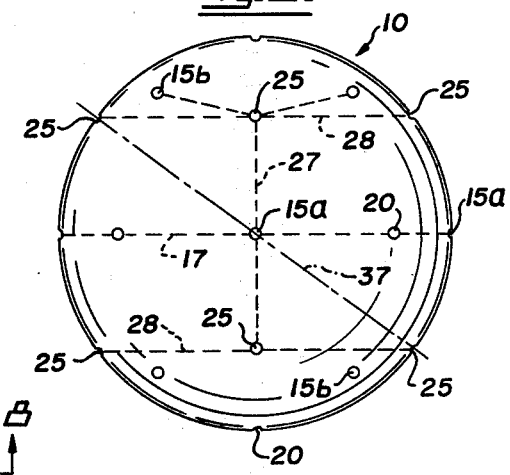
Figure 9:
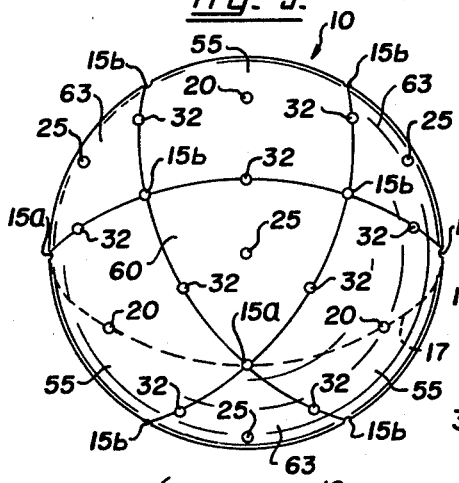
Figure 10:
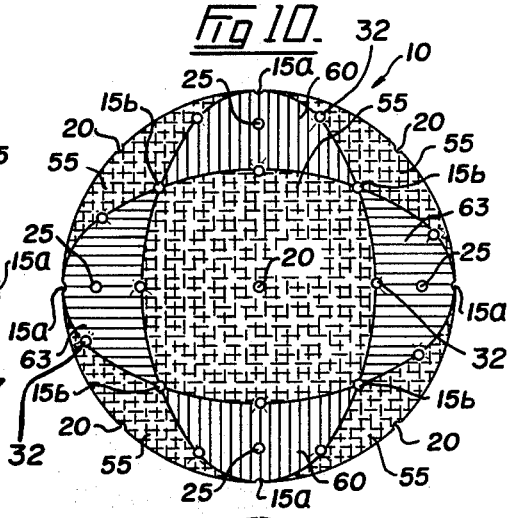
Figure 11:
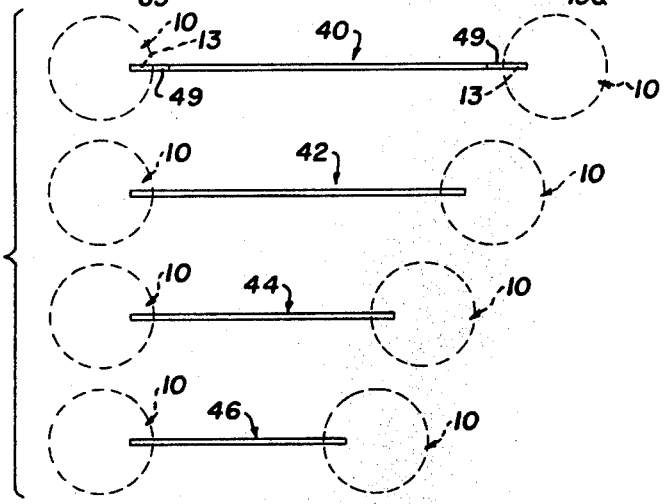
Figure 12:
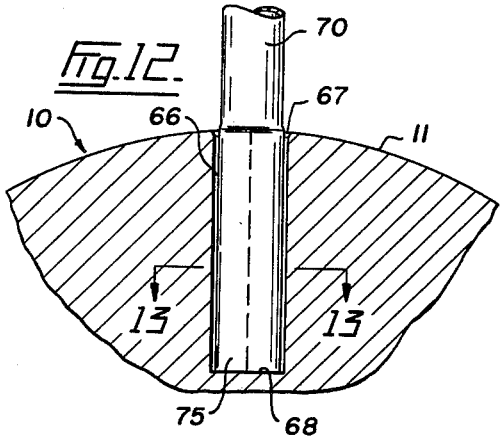
Figure 13:
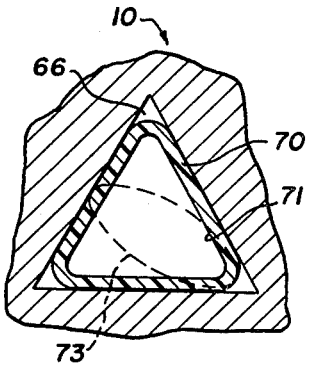
Figure 17:
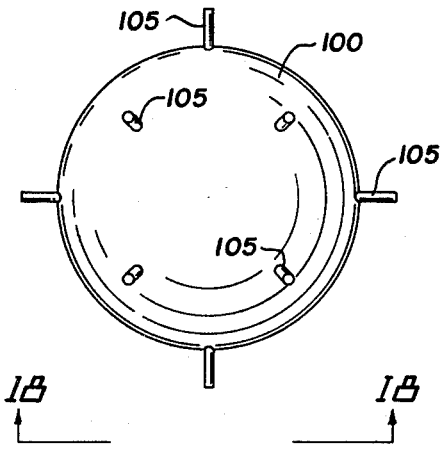
Figure 18:
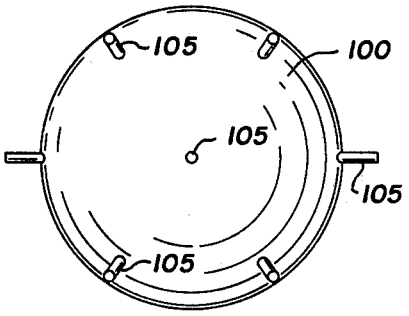
Figure 19:
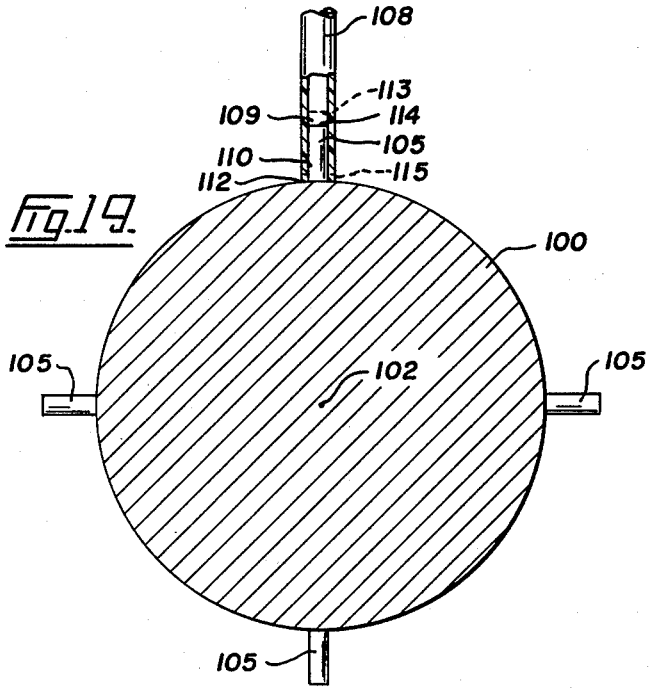
Figure 20:
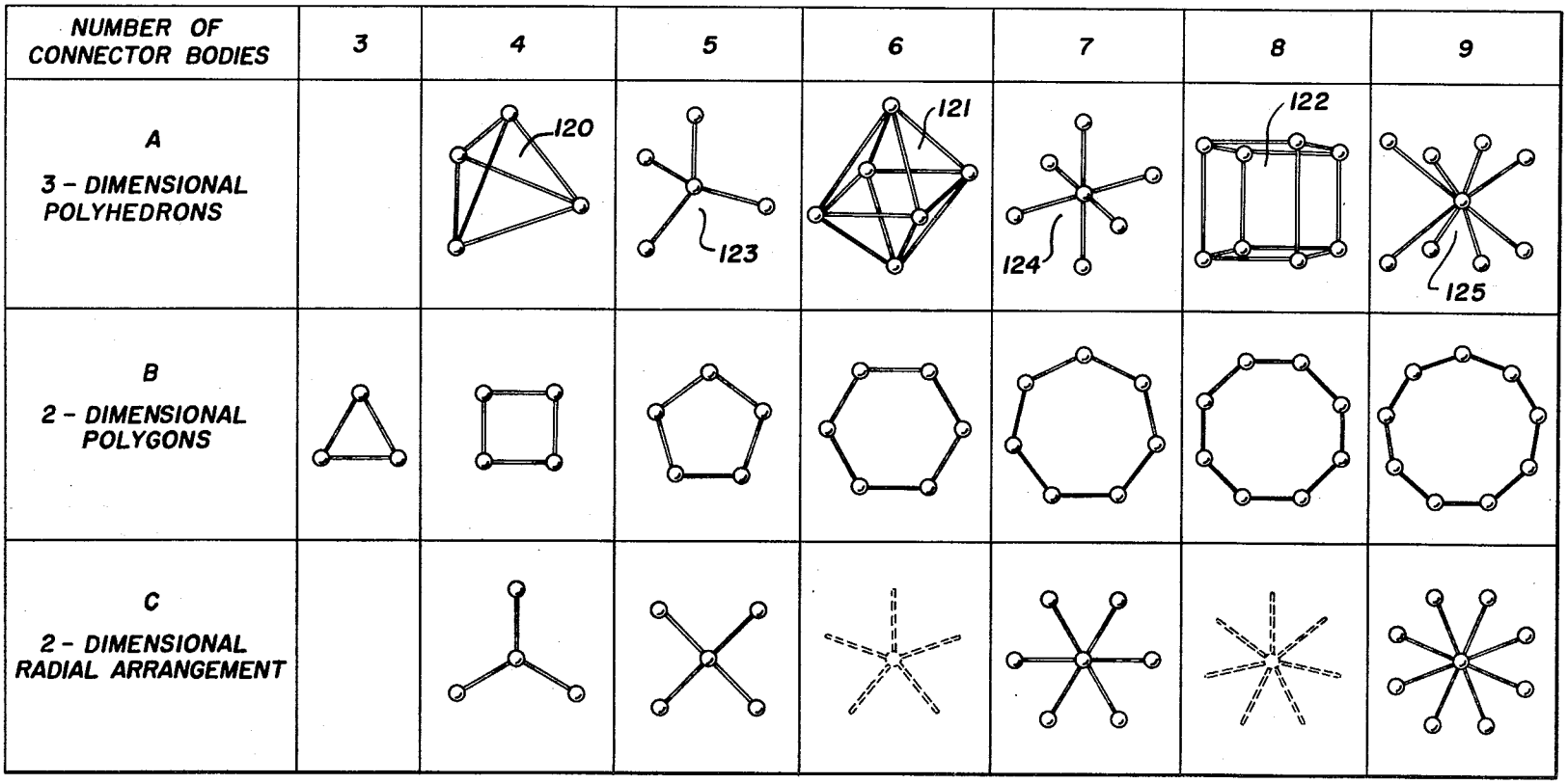
Figure 21:
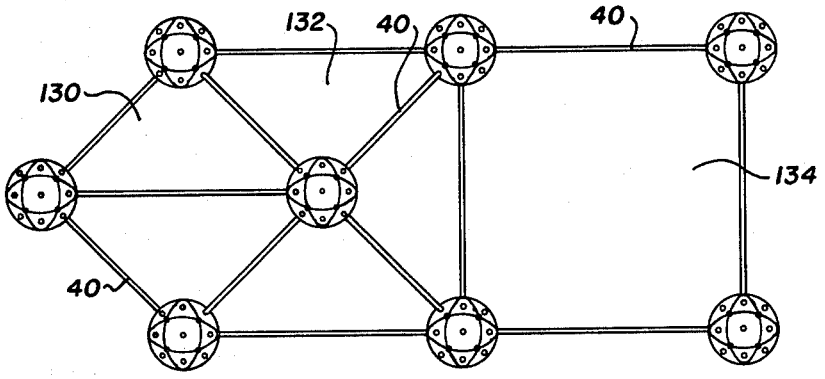
Figure 22:
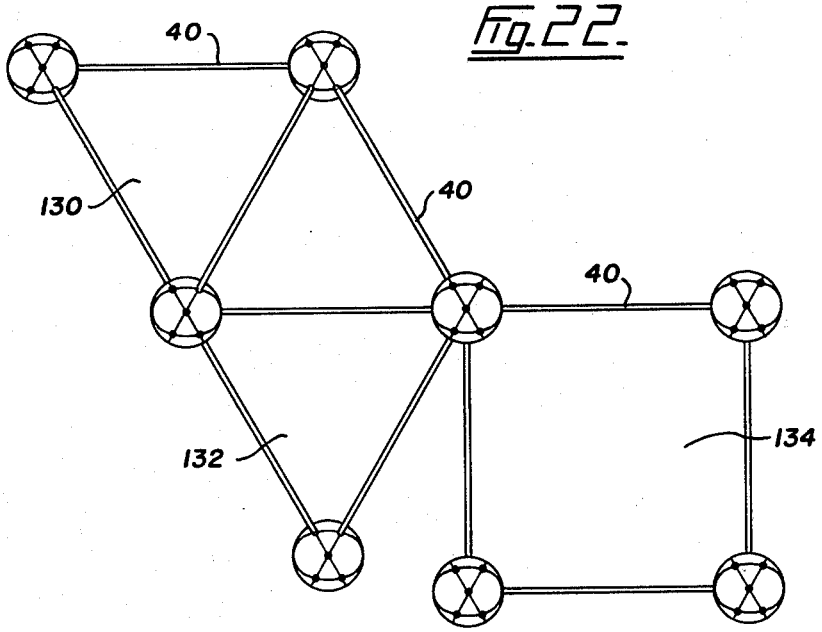

Examples of this invention are illustrated in the accompanying drawings, and reference is made to the top and side of spherical connector bodies for sake of convenience only. In the drawings, FIGS. 1 and 2 are plan and side elevations of a preferred spherical connector body or member, illustrating the arrangement of first order joint sockets thereof, FIGS. 3 and 4 are horizontal sections taken on the lines 3—3 and 4—4, respectively, of FIG. 2, FIGS. 5 and 6 are top and side views of the connector body, illustrating and emphasizing the arrangement of second order joint sockets and including first order sockets, FIGS. 7 and 8 are top and side views of the connector body, illustrating and emphasizing third order joint sockets and including the first and second order sockets, FIG. 9 is a view of the connector body of FIG. 8 but rolled slightly downwardly, illustrating and emphasizing the fourth order of joint sockets, and including the first, second and third order sockets, FIG. 10 is a plan view of the connector body with all the sockets therein and visually divided into regions by different colours, FIG. 11 illustrates connector members of four different lengths used in this toy apparatus with connector bodies indicated on the ends thereof, FIG. 12 is a sectional view of a preferred form of socket in a connector body, FIG. 13 is a section taken on the line 13—13 of FIG. 12, FIGS. 14 to 16 illustrate three different joint means arrangements for the connector members and the connecting members, FIGS. 17 and 18 are plan and side elevations, corresponding to FIGS. 1 and 2, of an alternative form of connector member of this invention having prong joint means, FIG. 19 is a horizontal section through the alternative connector member, corresponding to FIG. 3, and showing a connecting member on a prong of the connector member, FIG. 20 is a chart diagrammatically illustrating the optimal range of 2-dimensional and 3-dimensional configurations and FIGS. 21 and 22 are diagrams illustrating in plan and side elevation a combination of three geometric formations possible with this toy apparatus.

Figure 3:
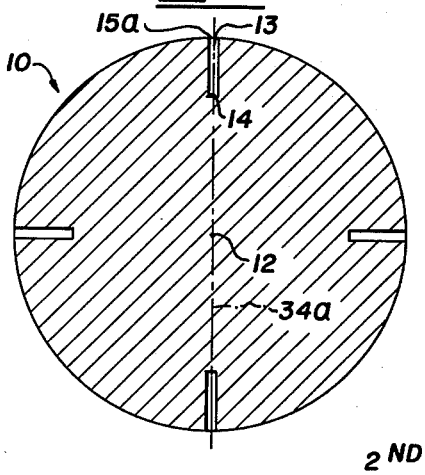
Figure 4:
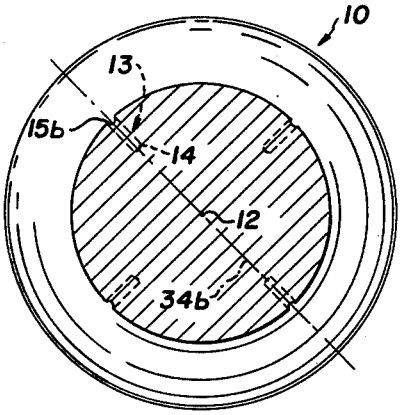

In the drawings, FIGS. 1 to 11 illustrate a preferred form of the invention. In this preferred form, 10 is a substantially spherical connector member in the form of a spherical body having an outer surface 11 and an inner central point illustrated at 12 in FIG. 1. The connector body 10 has joint means in the form of a plurality of radial sockets generally designated by the numeral 13 formed therein and opening out from its surface 11. These sockets are arranged in a plurality of different patterns which are designated herein as "first order, second order, third order and fourth order" sockets. The connector member or body 10 is provided with locating means at each socket 13, and in this example, the locating means are formed by bottoms or inner ends 14 of the sockets arranged around and a predetermined distance from the central point 12 of the connector member, as shown in FIGS. 3 and 4.

FIGS. 1 to 4 show the first order joint means or sockets which are made up of four sockets 15*a* and eight sockets 15*b*. The sockets 15*a* are spaced 90 degrees apart in a major plane 17 of the body 10, and there are four sockets 15*b* equidistantly spaced from the sockets 15*a* intersecting each of lesser planes 18 and 19 parallel to major plane 17 and spaced 45° therefrom on opposite sides thereof. By referring to FIG. 3 it will be seen that sockets 15*a* extend horizontally inwardly towards the center 12 of the connector body. The sockets 15*b* of planes 18 and 19 are respectively inclined radially inwardly towards the body center 12, see FIG. 4. All of the sockets in the connector body have the same cross sectional shape and size. From FIG. 1 it will be noted that the four sockets 15*b* shown form a square when viewed from above. Similarly, in FIG. 2, opposite upper and lower sockets 15*b* and two sockets 15*a* form a square, this square being unclear in this Figure because of the curvature of the body surface.

Figure 5:
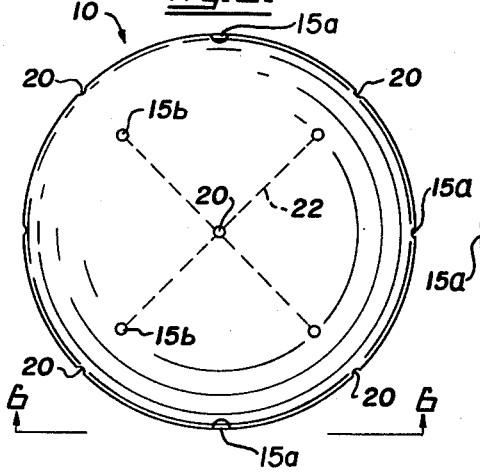
Figure 6:
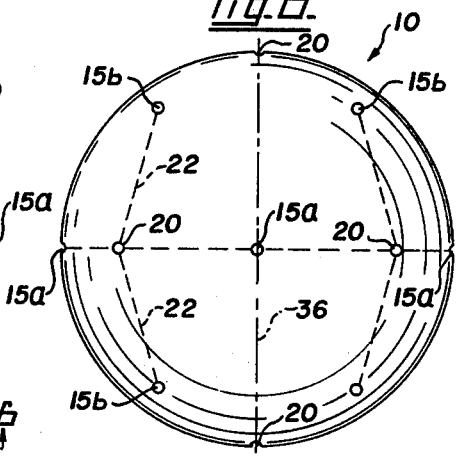

FIGS. 5 and 6 illustrate a plurality of second order joint means or sockets 20 in connector body 11. There are six sockets 20 and each of these sockets is located equally distant from four adjacent first order sockets arranged 90 degrees to each other, these distances being indicated by dotted lines 22 in FIGS. 5 and 6. There are four sockets 20 in the major plane 17 equally spaced from sockets 15*a* therein, and one at each end of the major axis of the connector body extending normal to said major plane. Sockets 20 in these Figures are shown in heavier lines than the socket 15*a* and 15*b* for the sake of clarity and are located centrally of the squares formed by first order sockets 15*a*, 15*b*.

In FIGS. 7 and 8, a plurality of third order sockets 25 are shown. There are eight sockets 25, and each is located equidistant from three adjacent first order sockets 15*a*, 15*b*, as indicated by lines 27. These adjacent sockets 15*a*, 15*b* are arranged in triangles when viewed from above, as apparent from FIG. 8. The sockets 25 are located on lesser planes 28 above and below the major plane 17 and spaced from planes 18 and 19.

FIG. 9 is a view similar to FIG. 8 but with the connector body rolled slightly downwardly. This Figure shows first, second and third order sockets described above, and includes fourth order sockets 32. These sockets 32 are located midway between adjacent pairs of first order sockets 15*a*, 15*b*. The two first order sockets 15*b* and the first order socket 15*a* shown centrally of FIG. 9 are clearly seen to be arranged substantially in a triangle in this Figure, and there is a fourth order socket 32 on each of the three sides of this triangle. The sockets 32 are located in lesser planes both above and below the major plane 17 and spaced from the planes of sockets 25 and from planes 18 and 19. There are 24 of these sockets 32, twelve of which are shown in FIG. 10.

Diametrically opposed first order joint means or sockets 15*a* in the major plane 17 are located at the ends of major axes of symmetry 34*a*, see FIG. 3. Diametrically opposite first order sockets 15*b* are at the ends of major axes of symmetry indicated at 34*b* in FIG. 4 and inclined relative to plane 17. Four of the second order sockets 20 are at opposite ends of major axes of symmetry in plane 17 similar to axis 34*a* and two of said sockets are at the ends of a major axis of symmetry 36 shown in FIG. 6. The third order sockets 25 are at the ends of major axes of symmetry 37, see FIG. 8, inclined relative to major plane 17 similar to axes 34*b* but at different angles from the angles of the latter. All of said axes pass through the central point 12 of the member body.

By referring to FIG. 2, it will be seen that the sockets 15*a* and 15*b* are arranged symmetrically around the centrally located first order socket 15*a* which is on the end of an axis of symmetry 34. In FIG. 5, sockets 15*b* and 20 are symmetrical around the centrally located second order socket 20 which is on the end of an axis of symmetry; in FIG. 6, sockets 15*a*, 15*b* and 20 are symmetrical about the central first order socket 15*a*; in FIG. 7, sockets 15*a*, 15*b* and 25 are symmetrical about central second order socket 20; in FIG. 8, sockets 15*b*, 20 and 25 are symmetrical about central socket 15*a*; and in FIG. 9, sockets 15*a*, 15*b*, 20 and 25 are symmetrical around central third order socket 25 which is on the end of an axis of symmetry.

An axis of rotational symmetry is an axis around which a pattern can be rotated (in the present apparatus through 90, 120 or 180 degrees) so that the identical pattern appears at a number of angular intervals less than one complete turn. In the case of each first order axis 34*a* or 34*b*, the pattern around the end of said axis repeats at 180 degree intervals; in the case of each second order axis 36, the pattern around the end of said axis repeats at 90 degree intervals; and in the case of each third order axis 37, the pattern around the end of said axis repeats at 120 degree intervals.

These symmetrical socket patterns are helpful when a person is constructing desired geometric structures. The user becomes familiar with the different symmetry patterns which are repeated on the surface of the connector body. In the process of construction, when he looks at a pattern on a connector body, it is easy to locate the same symmetry pattern on another body. Once the user locates the pattern, it is only necessary to rotate the ball around the central axis of symmetry of that pattern to position it to his eye exactly the same as the first pattern.

The construction toy of this invention includes a plurality of connector bodies 10, and a plurality of elongate and slender connecting members in four groups of different lengths. FIG. 11 shows a first group connector member 40, a second group connector member 42, a third group connector member 44, and a fourth group connector member 46, each with connector bodies 10, shown in broken lines, on the ends thereof. These slender connecting members may be formed of any suitable material such as plastic, metal or the like. It is preferable that each connector member has a certain degree of flexibility. The connector members may be solid but preferably are in the form of plastic tubes. As it is only necessary to have the ends of these connector members flexible, it will be understood that the members may be rigid or substantially rigid throughout a portion of their length as long as the end sections thereof are flexible, as indicated at 49 at the ends of connectors 40. The end sections 49 must be considerably longer than the depth of the sockets of the connector bodies.

The respective lengths of connecting members 42, 44 and 46 are different from each other and from connecting member 40, and are in proportion to the length of the latter member, as will hereinafter be described.

The connecting member 40 is the longest of the connecting members and is used commonly and interchangably for making exterior vertex connections in the assembled toy structures. The connecting members 42, 44 and 46 are used as the internal members for the cube, octahedron and tetrahedron, respectively, and are of lengths proportional to that of member 40.

The purpose of each connecting member is to retain the central point of a connector member on one end thereof a predetermined distance from the central point of a connector member on the opposite end of the connecting member. In this example, all of the joint sockets are the same depth with the bottoms thereof equidistant from the central points of their respective connector members. The inner ends of the sockets of each connector member enclose a ball or sphere having a diameter which will be referred to herein as the effective diameter of the connector member. These socket inner ends constitute first locating means in the connector members. The ends of the connecting members which engage the socket inner ends or bottoms are second locating means on said connecting members.

The effective length of each of the connecting members 40, 42, 44 and 46 is the distance between the locating means at opposite ends thereof. The effective length of the basic members 40 together with the effective diameter of the connector body determine the center to center length of exterior vertex connections in the assembled toy structures, or the basic module length of the toy. The basic module may be set at any desired length within the practical limits of the materials used in the toy apparatus.

In accordance with the above, the effective lengths of proportional connecting members 42, 44 and 46 are determined from the effective lengths of basic member 40 in the following manner.

Where the length ratio (R) is the ratio of the sum of the effective length of a proportional member (ELP) and the effective connector body diameter (ED) to the sum of the effective length of basic membes 40 (EL40) and the effective connector body diameter (ED), as in the following equation, $$R=(ELP+ED)/(EL40+ED)$$

and where, R equals 0.866, 0.707 and 0.612 correspond respectively to the proportional connecting members 42, 44 and 46; then the effective length of connecting member 42 (EL42) is $$EL42 = 0.866(EL40 + ED) - ED,$$

the effective length of connecting member 44 (EL44)

$$EL44 = 0.707(EL40 + ED) - ED,$$

and the effective length of connecting member 46 (*EL*46)

$$EL46 = 0.612(EL40 + ED) - ED.$$

It is preferable, although not absolutely necessary, to provide visual identification symbols on the surface of connector body 10. In the illustrated form of the invention, the symbols are divided into three different regions which are repeated to cover the body surface. There are a plurality of first regions 55 each defined by four adjacent first order sockets 15*a*, 15*b*, see FIGS. 1 and 9, this being the squre mentioned above. The region 55 shown in FIG. 1 is outlined by broken lines 57. Each of these regions 55 contains a second order socket 20 centrally thereof. Each of a plurality of spaced-apart second identification regions 60 is defined by a group of three triangularly arranged adjacent first order sockets 15*a*, 15*b*, each of said regions 60 containing a third order socket 25 centrally thereof. A plurality of third regions 63 are defined by groups of three triangularly arranged adjacent first order sockets 15*a*, 15*b* and are alternately arranged between regions 60. There is also a third order socket 25 centrally located in each region 63. One each of regions 60 and 63 is clearly shown in FIG. 2.

There is a socket 32 in each of the three sides of regions 60 and 63, each of which contains a socket 25, and as there are eight of these sockets there are twenty four sockets 32.

The regions 55, 60 and 63 are made readily distinguishable from each other in any desired manner. In the preferred form of the invention, these regions are of different colours such as, for example, region 55 being yellow, region 60 red, and region 63 blue, see FIG. 10. However, these regions can be graphically distinguished from each other by other means, such as by different cross hatching, dots, multiple stars or the like.

It is also preferable to distinguish the connecting members 42, 44 and 46 from each other and in accordance with the region identification symbols. If the regions are identified by different colours, it is preferable to identify the connecting members in the same manner. In this case, the connecting members 42, 44, and 46 are blue, yellow and red to correspond with regions 63, 55, and 60, respectively. Connecting members 40 are of a colour different from the others, such as orange.

FIGS. 12 and 13 are enlarged sectional views showing a preferred form of socket and connecting member arrangement. The illustrated socket 66 is of substantially triangular shape in cross section, and has an enlargement 67 at its entrance end opening out through the surface 11 of the connector body 10. The illustrated connector member 70 is of tubular construction and preferably has a certain amount of flexibility. The end of the connecting member is of such size as to be deformed or compressed when it is inserted into a socket 66 so that the end assumes a substantially triangular shape, as shown at 71 in FIG. 13. The frictional engagement of the member end with the three walls of the sockets, and the depth of the socket are such that although the connecting member can be easily inserted into and withdrawn from the socket, said member is firmly held in position by the socket walls. This type of joint allows complete longitudinal and rotational adjustment of the member in the socket.

The sockets can be square in cross section, but the square section is not as good as the triangular section. The reason for this is that the ends of the connecting members may be flattened out during use, and consequently if an end is inserted diagonally of the square socket, the member would be loose and could drop out. With triangular sockets, there will always be a strong frictional connection between the members and sockets since the flattened member ends will fit between a corner of the socket and the wall opposed to said corner, as shown in broken lines at 73 in FIG. 13.

The socket 66 has a bottom 68 which is positioned a predetermined distance from the central point 12 of the body member 10, this central point not being shown in FIG. 12. When the connecting member 70 is inserted into socket 66, the socket bottom 68 acts as a stop to position the connecting member properly relative to the central point of the body member. Thus the socket bottom 68 and the end 75 of the connecting member function as physical locating means by means of which the connecting member 70 is properly located relative to the central point of body member. The socket 66 acts as the joint means of the body member while the connecting member end 71 acts as the joint means of said connecting member.

The following is an example only of toy structure apparatus constructed in accordance with this invention:

Basic Module length: 8 inch—20.32 cm
Effective diameter of body, ED: 1 in.—2.54 cm
Effective length of member 40, EL40: 7 in.—17.78 cm
Socket Depth: 0.5 in.—1.27 cm
Body Diameter: 2 in.—5.08 cm
Diameter of connecting member: - 3 m
Proportional Effective Lengths member 42 = 8.66 (7 + ) − 1
= 5.928 in. = 15.05 cm member 44 = .707 (7 + 1) − 1
= 4.656 in. = 11.82 cm member 46 = .612 (7 + 1) − 1
= 3.896 in. = 9.89 cm It is desirable that the connecting members be reasonably rigid but flexible either throughout their lengths or throughout substantial portions of the end sections thereof. The connector members are preferably made from material having suitable resilience, such as high density plastic, for example, polyethylene. The flexibility in the connecting members make it possible to insert one end of a member into a socket without having to loosen or simultaneously adjust the opposite end thereof during a construction operation.

The resilient connecting members and the 3-sided sockets in the connector bodies provide for proper frictional engagement between the connecting members and the socket walls, and minimize the problems of loosening and overtightening of the members.

Figure 14:
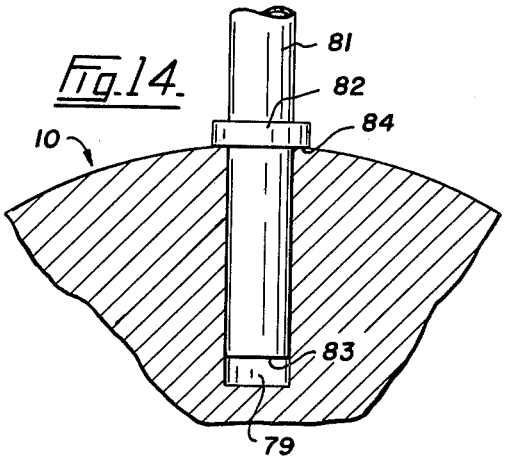
Figure 15:
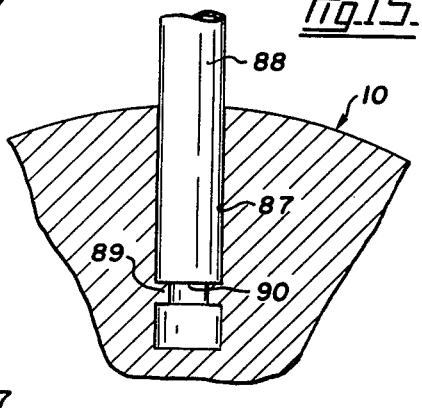
Figure 16:
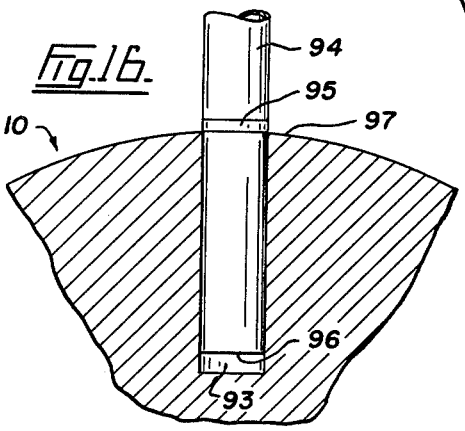

FIGS. 14 to 16 illustrate alternative and representative locating means for properly locating a connecting member relative to the central point of the connector body member with which it is interconnected. In these Figures, the member body 10 is illustrated with a socket 79 therein which corresponds to any one of the sockets mentioned above.

FIG. 14 shows a connecting member 81, which corresponds to any one of the above-mentioned connecting members, fitting in the socket 79. The connecting member has a collar or locating means 82 thereon spaced a predetermined distance from the member end 83. When the connecting member is inserted into the socket, this collar contacts the surface or locating means 84 of the body member 10 at the socket to limit the inward movement of the connecting member. The end 83 of the connecting member is clear of the bottom of socket 79 at this time. The collar 82 and the contact surface 84 are physical locating means which cooperate to properly locate the connecting member 81 longitudinally relative to the central point of the body member 10. In this alternative, all of the connecting members have collars 82 thereon near both ends thereof so that said connecting members will always be properly located when interconnected with the body members of the toy apparatus. In this example, the distance between diametrically opposite points of contact at collars 82 is the effective diameter of the connector member.

FIG. 15 illustates a representative socket 87 in a connector body member 10, and a representative connecting member 88 fitting in the socket. The socket is provided with a shoulder or locating means 89 therein spaced a predetermined distance from the cental point of the body member 10. The end or locating means 90 of the connecting member 88 engages shoulder 89 when the connecting member is inserted in the socket. The shoulder 89 and the end of connecting member 90 are as physical locating means which co-operate to properly locate the connecting member 88 longitudinally relative to the central point of body member 10. All of the sockets of the member bodies of this alternative of the apparatus are formed with positioning shoulders 89. The distance between diametrically opposite points of contact at shoulders 89 is the effective diameter of the connector member.

FIG. 16 illustrates a connector body member 10 with a representative socket 93 therein, and a representative connecting member 94 fitted in this socket. The connecting member has a visual marking or locating means 95 thereon, such as a colour band or annular notch, spaced a predetermined distance from the end 96 of the connecting member. When the connecting member 94 is inserted into socket 93, it is pressed in until the marking 95 is located at the surface or locating means 97 around the entrance to the socket to co-operate therewith to properly locate the connecting member relative to the central point of the body member 10. With this alternative, all of the connecting members have a visual marking 95 near each of the ends thereof. When marking 95 is aligned with body member surface 97, the end 96 of the connecting member is clear of the bottom of socket 93. Thus, the marking 95 and the body member surface 97 are visual locating means which co-operate to locate properly the connecting member 94 longitudinally relative to the central point of the body member 10.

The distance between diametrically opposite points where the markings 95 align with surface 97 is the effective diameter of this connector member.

The sockets and the connecting member ends of the apparatus of FIGS. 14, 15 and 16 constitute the joint means of the connector members and the connecting members respectively.

FIGS. 17, 18 and 19 illustrate an alternative form of toy apparatus embodying this invention. This alternative apparatus includes a plurality of connector body members and a plurality of connector members of different lengths in the manner described above.

In FIGS. 17 to 19, 100 is a substantially spherical connector member or body member having an inner central point 102 and a plurality of prongs 105 radiating from the surface thereof. These prongs are preferably the same length.

The radial prongs 100 correspond to the sockets of the connector body members 10 and are arranged in the same first, second, third and fourth orders as said sockets. The body member 100 is provided with visual identification symbols, and in this example the prongs of each order may be identified by different markings, such as by different colours.

The same connecting members may be used with member bodies 100 as with member bodies 10. However, both ends of each connecting member must have a socket therein of such size as to fit over and grip a prong 105. FIG. 19 shows a connecting member 108 having sockets 109 opening out from the ends 110 thereof. The socket 109 fits over and grips one of the prongs 105. The end or locating means 110 of the connecting member engages the adjacent surface or locating means 112 of the body member around the prong to limit the inward movement of the connecting member. Thus, the end 110 of the connecting member 108 and the surface 112 of the body member 100 are locating means which properly locate said connecting member longitudinally relative to the central point 102 of said body member. The distance between diametrically opposite points of contact at the ends 110 of connecting members is the effective diameter of the connector member.

If desired, the sockets 109 of connecting members 108 may have bottoms 113, shown in dotted lines in FIG. 19, to be engaged by outer ends 114 of the prongs to limit the inward movement of connector member prongs 105. With this arrangement the ends of connecting members 108 would not reach the surface of body 100, as indicated at 115. In this case, the outer ends 114 of the prongs 105 would constitute the effective diameter of the connector member. Each socket bottom 113 is a locating means of a connecting member, and each prong end 114 is a locating means of a connector member.

The sockets of the connecting members 108 and the prongs 105 of the connector members constitute the joint means of the connecting members and the connector members, respectively.

The connecting members used with connector member bodies 10 of FIGS. 1 to 11 constitute prongs fitting in the sockets of these body members. With the alternative of FIGS. 17 to 19 this arrangement is reversed, that is, the sockets are in the connecting members and the prongs are on the connector members. Otherwise, these two main forms of the invention are the same and are used to form the geometrical configurations in the same manner.

The chart of FIG. 20 illustrates the range of optimal configurations possible by the use of this toy apparatus. These configurations minimize the number of different connecting member lengths and relative angles within a system of configurations composed of 3 to 9 connector bodies. Although reference is made below to the toy apparatus of FIGS. 1 to 16, it is to be understood that the chart also applies to the configurations possible with the alternative of FIGS. 17 to 19.

This chart illustrates the range of structures assembled with the common connecting member 40 forming all exterior connections, and the connectors 42, 44 and 46 forming interior connections. The configurations are categorized by the number of spheres contained in each and are separated by type into the following three series:

Series A of six 3-dimensional polyhedron configurations,

Series B of seven 2-dimensional polygon configurations, and

Series C of six 2-dimensional radial configurations.

The connecting members 40 used commonly and interchangeably to form the outside structures of these configurations provide a common scale which in combination with the arrangement of sockets or prongs allows these figures to be connected directly to one another. Furthermore, the three shorter lengths 42, 44 and 46 of the connecting members are used for constructing the internal structures of the basic configurations. For any given length of common vertex connecting member 40 properly positioned by the locating means, specific ratios between the vertex and internal connecting members exist.

In FIG. 20 the three dimensional series A shows the basic figures constructed without a central connector body in the case of the even numbered categories containing 4, 6 and 8 connector bodies, whereas for the odd numbered categories of groups of 5, 7 and 9 connector bodies, said bodies are arranged around a central connector body.

To develop the preferred overall arrangement of sockets or prongs, it is first necessary to provide six functional sets of sockets or prongs, namely, three vertex arrangements shown at 120, 121 and 122 and three central arrangements shown at 123, 124 and 125 for the tetrahedron, octahedron and cube, respectively. The number of these different socket or prong arrangements is reduced as a result of the fact that the center of the tetrahedron 123 is a subset of the central arrangement of the cube 125; and the vertex of the cube 122 is a subset of the central arrangement of the octahedron 124. Thus, there are only four primary sets of sockets which together allow the construction of the complete 3-dimension series.

The first group of sockets 15*a*, 15*b* (or prongs) allows for the construction of the vertex and central arrangements of the tetrahedron and octahedron. The second order of sockets 20 (or prongs) allows construction of the center of the octahedron and the vertex of the cube. The third order sockets 25 (or prongs) allows the construction of the center of the cube and the center of the tetrahedron. The fourth order sockets 32 (or prongs) permit the construction of the vertex of the triangle with a central connector body as shown in the chart in category 4, series C. The arrangement of the four orders provide for the construction of the 3-dimensional configurations completely and accurately. The 2-dimensional configurations of series B can be accurately constructed for the categories 3, 4, 6 and 8, while categories 5, 7 and 9 may be constructed within 5% angular error, well within the flexible range of the connecting members. The 2-dimensional configurations of series C can be completely constructed excepting for categories 6 and 8. Thus all but two of the 19 configurations illustrated in the chart of FIG. 20 may be constructed by means of this toy apparatus.

With the toy apparatus it is possible to construct complex structures by direct interconnection of the tetrahedron, octahedron, and cube configurations as shown in FIGS. 21 and 22. In these Figures, a tetrahedron 130, an octahedron 132 and a cube 134 are connected directly together by the use of a basic connecting member 40. The connector body members of FIGS. 21 and 22 are constantly oriented in space regardless of the location of an individual connector in a given basic configuration or direct interconnection of them. The user may rely upon this constant characteristic of the toy apparatus as an aid in constructing more advanced structures involving larger numbers of connectors.

The principle educational objective of this toy apparatus is that by working from a central connector, the user will discover how to construct the tetrahedron, octahedron, and cube. He or she may then construct the basic configurations without reliance on their internal structures and may also explore more complex interconnections among them. The system of identification symbols on the connector bodies is designed to indicate the arrangements of sockets or prongs and relative connecting member lengths necessary to construct the tetrahedron, octahedron and cube from a central connector.

As the connecting member 44 and the four cornered regions 55 of the connector body member are both yellow, it is a simple matter to construct the octahedron by first inserting members 44 in the central sockets 20 or placing them on the corresponding prongs of these yellow regions. To complete the figure, another connector body is added at the free end of each of these connecting members. When the exterior connections are made by inserting yellow member 44 in the center sockets 20 or are placed on the corresponding prongs of the yellow regions of the exterior connectors, the correct vertex arrangement will appear on the exterior connector as the four corner sockets or prongs of the yellow regions through which the central connection is made. The vertex sockets 15*a*, 15*b* or the corresponding prongs on the exterior connectors may then be joined together by the common vertex to vertex orange connecting members 40 to complete the octahedron. A tetrahedron is constructed by inserting red connecting members 46 in the central sockets 25 or on the corresponding prongs of the red regions 60 of a connector body. Then a connector body is placed on the free end of each of these connector members in the same manner. The appropriate vertex sockets 15*a*, 15*b* or corresponding prongs on the exterior connector bodies are joined together by the orange members 40 to complete the figure.

The cube is constructed by inserting blue connecting members 42 in the central sockets 25 or on the corresponding prongs of both the red and blue three cornered regions 60 and 63. Then a connector body is placed on the free end of each of these connecting members. When the exterior connection has been made by inserting the blue member 42 in the central socket or on the corresponding prong of the blue region, then the vertex pattern of the cube appears as three central sockets 20 or prongs of three adjacent regions 55.

I claim:

1. Toy apparatus for the formation of regular tetrahedron, octahedron and cube structures, comprising a plurality of substantially spherical connector members each having an interior central point, each of said connector members having a plurality of radial first joint means arranged around the central point of the connector member, all of of said first joint means of each connector member being on opposite ends of axes of rotational symmetry through the central point, said first joint means being arranged symmetrically around the ends of said axes, first locating means at each first joint means, all of the first locating means of each connector member being equidistant from the central point of said member and defining in co-axial pairs respective effective diameters thereof, a plurality of elongate and slender connecting members each having second joint means at opposite ends thereof adapted to co-operate with the first joint means of connector members to interconnect the connector members and connecting members, and second locating means adjacent each of the opposite ends of each connecting member, the distance between the second locating means of each connecting member constituting the effective length of the latter connecting member, and when connector members and connecting members are being interconnected by the first and second joint means thereof, the first and second locating means thereof co-operate to position said connecting members angularly in lines forming vertices and central intersections of regular tetrahedron, octahedron and cube structures.

2. Toy apparatus as claimed in claim 1 in which each connector member comprises a substantially spherical body, the first joint means of each of said connector members comprises a plurality of radial sockets on the connector body, and the second joint means at each end of each connecting member comprises an end of the member sized removably to fit in the body sockets.

3. Toy apparatus as claimed in claim 1 in which each connector member comprises a substantially spherical body, the first joint means of each of said connector members comprises a plurality of radial prongs projecting outwardly relative to the body thereof, and the second joint means at each end of each connecting member comprises a socket in the connecting member end opening outwardly from said end sized to receive and grip the prongs of the connector member bodies.

4. Toy apparatus as claimed in claim 1, 2 or 3 in which said joint means of each of said connector members comprises a first order of twelve joint means comprising four joint means spaced 90 degrees apart in a major plane of the connector member, and four joint means equally spaced from the major plane joint means intersecting each of two lesser planes parallel to the major plane and located 45 degrees from and on opposite sides of the major plane.

5. A toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, and a second order of six joint means each located equidistant from four adjacent first order joint means that are arranged in a square.

6. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, and a third order of eight joint means each located equidistant from three adjacent first order joint means that are arranged in a triangle.

7. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, and a fourth order of twenty-four joint means located midway between adjacent pairs of first order joint means that are arranged in a triangle.

8. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, a second order of six joint means each located equidistant from four adjacent first order joint means that are arranged in a square, and a third order of eight joint means each located equidistant from three adjacent first order sockets that are arranged in a triangle.

9. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, a second order of six joint means each located equidistant from four adjacent first order joint means that are arranged in a square, a third order of eight joint means each located equidistant from three adjacent first order sockets that are arranged in a triangle, and a fourth order of twenty-four joint means each located midway between adjacent pairs of first order joint means that are arranged in a triangle.

10. Toy apparatus as claimed in claim 1, 2 or 3 in which said connecting members are divided into a plurality of groups of different lengths, the lengths of a first of said groups being basic, and the lengths of the remaining of said groups being different from each other and each being proportional to the length of the first group members.

11. Toy apparatus as claimed in claim 1, 2 or 3 in which said connecting member are divided into four groups of different lengths, the length of each connecting member of a first of said groups being basic, and the effective length of a connecting member of a second of said groups being 0.866 (EL first group member+ED)−ED the effective length of a connecting member of a third of said groups being 0.707 (EL first group member-+ED)−ED the effective length of a connecting member of a third of said groups being 0.612 (ED first group member-+ED)−ED wherein EL is the effective length of a connecting member and ED is the effective diameter of a connector member.

12. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides on the major plane, a second order of six joint means each located equidistant from four adjacent first order joint means that are arranged in a square, a third order of eight joint means each located equidistant from three adjacent first order sockets that are arranged in a triangle, and perceptible identification symbols on the surface of each connector member relative to said second and third order joint means.

13. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, and a second order of six joint means each located equidistant from four adjacent first order joint means that are arranged in a square, a third order of eight joint means each located equidistant from three adjacent first order sockets that are arranged in a triangle, perceptible identification symbols on the surface of each connector member relative to said second and third order joint means, said symbols being as follows:

(a) regions defined by arcs connecting alternate groups of three adjacent first order joint means that are arranged in triangles and each containing a third order joint means centrally thereof, and (b) regions defined by arcs connecting four adjacent first order joint means and each containing a said second order joint means located centrally thereof, and (c) regions defined by arcs connecting groups of three adjacent first order joint means that are arranged in triangles and located between said regions (a) and each containing a third order joint means centrally thereof.

14. Toy apparatus as claimed in claim 1, 2 or 3 in which said joint means of each of said connector members comprises a first order of twelve joint means comprising four equally-spaced joint means in a major plane of the connector member, and four joint means equally spaced from the major plane joint means intersecting each of two lesser planes parallel to the major plane and located 45 degrees from and on opposite sides of the major plane, and a second order of six joint means each located equidistant from four adjacent first order joint means that are arranged in a square, and a third order or eight joint means each located equidistant from three adjacent first order sockets that are arranged in a triangle, perceptible identification symbols on the surface of each connector member relative to said second and third order joint means, said symbols being as follows:

(a) graphically distinguished regions defined by alternate groups of three adjacent first order joint means that are arranged in triangles and each containing a third order joint means centrally thereof, (b) different graphically distinguished regions defined by four adjacent first order joint means that are arranged in a square and each containing a second order joint means located centrally thereof, and (c) different graphically distinguished regions defined by groups of three adjacent first order joint means that are arranged in triangles, and located between said regions (a) and each containing a third order joint means centrally thereof.

15. Toy apparatus as claimed in claim 1, 2 or 3 in which said connecting members are divided into a plurality of groups of different lengths, the lengths of a first of said groups being basic, and the lengths of the remaining of said groups being different from each other and each being proportional to the length of the first group members, perceptible identification symbols on the surface of each connector member relative to said second and third order joint means, said symbols being as follows:

(a) coloured regions defined by alternate groups of three adjacent first order joint means that are arranged in triangles and each containing a third order joint means centrally thereof, (b) different coloured regions defined by four adjacent first order joint means that are arranged in a square and each containing a said second order joint means located centrally thereof, (c) regions of a colour different from the colours of regions (a) and (b) defined by groups of three adjacent first order joint means that are arranged in triangles and located between said regions (a) and each containing a third order joint means centrally thereof, said connector members being visually identified to correspond to said identification symbols, said member identification being as follows:

said first group members being of a different colour from the above-mentioned colours and being for the first order joint means, a second group of said members being the same colour as that of said regions (a), a third group of said members being the same colour as that of said regions (b) and a fourth group of said members being the same colour as that of said regions (c).

16. Toy apparatus as claimed in claim 2 in which each connector member body socket is substantially triangular in cross-section to form three contact surfaces, and said connecting members are tubular at the ends of thereof and sized to squeeze into the body member sockets.

17. Toy apparatus as claimed in claim 2 in which each of said first locating means comprises a bottom in each socket of each member body spaced a predetermined distance from the central point of said member body, and each of said second locating means comprises an end on a connecting member to engage the socket bottoms of the member bodies to locate said each connecting member longitudinally properly relative to the central points of the member bodies.

18. Toy apparatus as claimed in claim 2 in which each of said second locating means comprises a collar on a connecting member spaced a predetermined distance from an end thereof, and each of said first locating means comprises a surface on a member body at a socket thereof to be engaged by the collars of the connecting member to locate said connecting members longitudinally properly relative to the central points of the member bodies.

19. Toy apparatus as claimed in claim 2 in which each of said first locating means comprises a stop shoulder in each socket of a member body spaced a predetermined distance from the central point of said body, and each of said second locating means comprises an end on a connecting member to engage said socket shoulders of the member bodies to locate said each connecting member longitudinally properly relative to the central points of the member bodies.

20. Toy apparatus as claimed in claim 2 in which each of said second locating means comprises a visual marking on a connecting member spaced a predetermined distance from an end thereof, and each of said first locating means comprises a surface on a member body at a socket thereof with which the visual markings of the connecting members can be aligned to locate said connecting members longitudinally properly relative to the central points of the member bodies.

21. Toy apparatus as claimed in clam 3 in which each of said first locating means comprises a surface on a body at a radial prong thereof, and each of said second locating means comprises an end on a connecting member to engage said body surfaces to locate said each connecting member longitudinally properly relative to the central points of the member bodies.

22. Toy apparatus as claimed in claim 3 in which each of said first locating means comprises a bottom in a socket of a connecting member, and each of said second locating means comprises an outer end on a prong to engage the socket bottoms of the connecting members to locate said connecting members longitudinally properly relative to the central points of the connector member bodies.

* * * * *